US006443060B2

(12) United States Patent
Göttling et al.

(10) Patent No.: US 6,443,060 B2
(45) Date of Patent: Sep. 3, 2002

(54) DEVICE FOR FEEDING A PRESSURE MEDIUM TO A CYLINDER BEARING A PRINTING PLATE OR A RUBBER BLANKET

(75) Inventors: Josef Göttling, Friedberg; Godber Petersen, Augsburg, both of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 1 days.

(21) Appl. No.: 09/746,414

(22) Filed: Dec. 21, 2000

(30) Foreign Application Priority Data

Dec. 22, 1999 (DE) ..... 199 61 866

(51) Int. Cl.[7] ..... B41F 5/00; B41F 13/10; B41F 21/00

(52) U.S. Cl. ..... 101/216; 101/477; 101/375

(58) Field of Search ..... 101/415.1, 375, 101/409, 479, 477, 308, 407

(56) References Cited

U.S. PATENT DOCUMENTS

| | | | | |
|---|---|---|---|---|
| 4,030,415 A | | 6/1977 | Fellows | |
| 4,089,265 A | | 5/1978 | White et al. | |
| 5,076,166 A | * | 12/1991 | Herold et al. | 101/415.1 |
| 5,322,013 A | | 6/1994 | Haupenthal | |
| 5,398,606 A | * | 3/1995 | Becker | 101/409 |
| 5,522,316 A | * | 6/1996 | Singler | 101/479 |
| 5,701,818 A | * | 12/1997 | Mohrmann | 101/375 |

FOREIGN PATENT DOCUMENTS

| | | |
|---|---|---|
| DE | 1 097 452 | 1/1961 |
| DE | 25 42 748 | 4/1976 |
| DE | 27 42 002 | 3/1979 |
| DE | 42 03 550 | 8/1993 |
| DE | 41 12 666 | 7/1994 |
| DE | 296 00 845 | 4/1996 |
| EP | 366 395 | 5/1990 |
| GB | 22 74 812 | 8/1994 |

* cited by examiner

*Primary Examiner*—Andrew H. Hirshfeld
*Assistant Examiner*—Marvin P Crenshaw
(74) *Attorney, Agent, or Firm*—Cohen, Pontani, Lieberman & Pavane

(57) ABSTRACT

A feed assembly is provided which feeds a pressure medium to a cylinder and fixes the cylinder in position, independently of whether or not the pressure medium to be connected is supplied. A feed part can be placed on a feed opening of the cylinder by an actuating element which can be controlled independently of any control of the pressure medium. An outlet of the feed part and the feed opening engage one another and lock the cylinder against rotation.

13 Claims, 2 Drawing Sheets

DEVICE FOR FEEDING A PRESSURE MEDIUM TO A CYLINDER BEARING A PRINTING PLATE OR A RUBBER BLANKET

BACKGROUND OF THE INVENTION

1. Field of the Invention

The invention relates to a device for feeding a pressure medium to a rotatable cylinder. In particular, the invention relates to a device for feeding a pressure medium to a rotating cylinder upon which a printing plate or a rubber blanket can be clamped.

2. Description of the Related Art

German reference DE 42 03 550 C2 discloses a device for feeding a pressure medium to a cylinder, in which a feed part can be lowered onto the peripheral face of the journal of the cylinder. In this case, the movement of the feed part is coupled to the actions of switching the pressure of the medium on and off. As a result, when the pressure medium is switched off, the feed part cannot be placed onto the cylinder.

German reference DE 43 03 381 A1 discloses a plate cylinder to which compressed air can be fed by placing a feed part onto the end of the cylinder body. In this case, fixing the plate cylinder in position is not possible.

SUMMARY OF THE INVENTION

The object of the present invention is to provide a device for feeding a pressure medium to a cylinder by means of which the cylinder can be fixed in position, independently of the pressure medium to be connected.

According to the present invention, the object is achieved by an outlet of the feed part and the feed opening being largely engaged over one another so the cylinder is positively secured or blocked against rotation. This blocking is possible without the pressure medium being connected. The device also functions reliably as a torque support, i.e., the drive motor can be kept energized at a standstill, which is advantageous for the control system. The device requires minimal space. The control system can be automated by a controllable actuating element.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference characters denote similar elements throughout the several views, the present invention is described in schematic form as follows.

DETAILED DESCRIPTION OF THE PRESENTLY PREFERRED EMBODIMENTS

Figure 1:
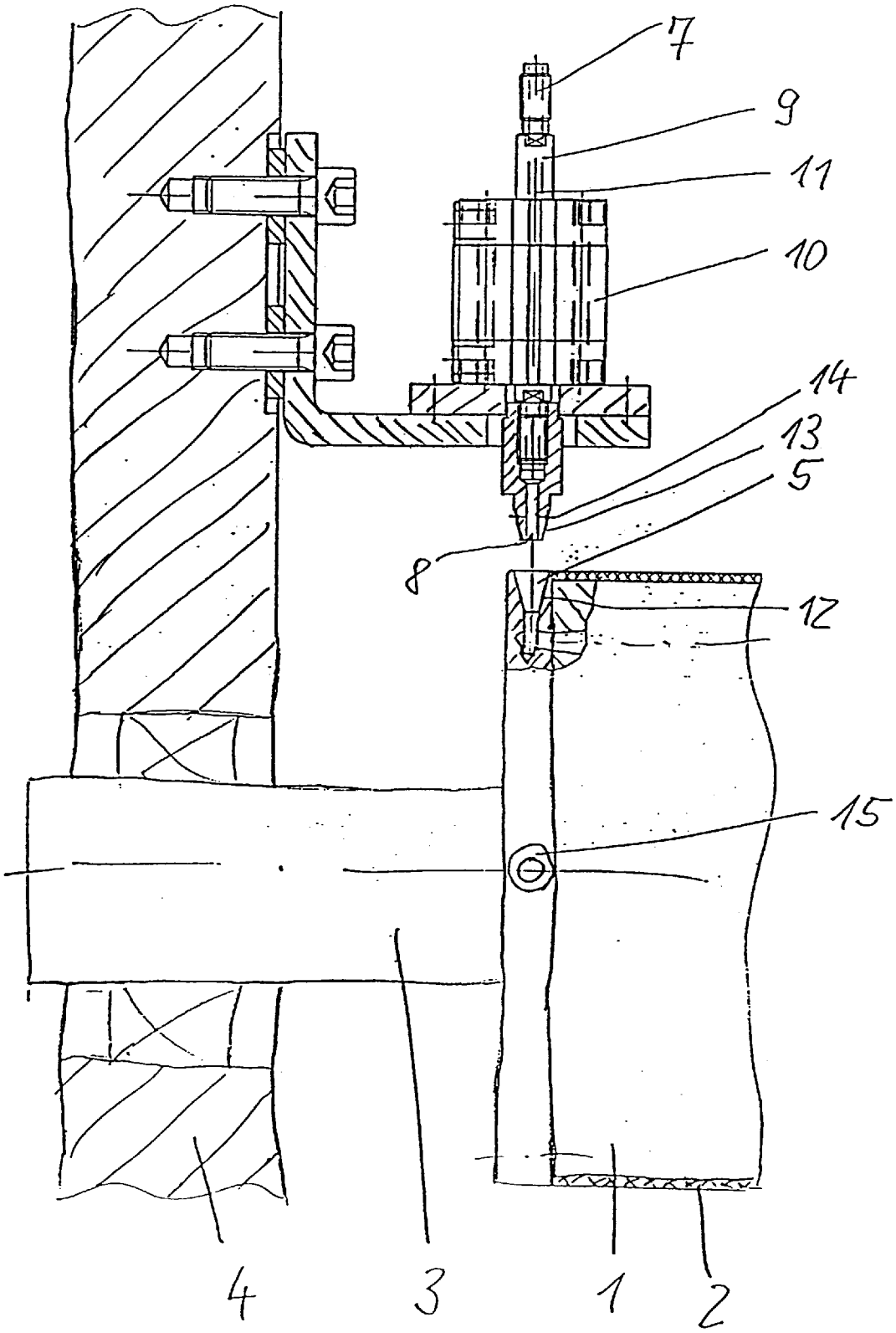
FIG. 1 shows a device for feeding a pressure medium to a cylinder, arranged on a periphery of the cylinder.

FIG. 1 shows a cylinder upon which a printing plate sleeve 2 is clamped. The cylinder 1 is mounted in a frame 4 by its journal 3. The cylinder 1 bears a second journal (not shown) by which it is mounted in the frame 4. The cylinder 1 can be in the form of a plate cylinder of a printing machine. Alternatively, it can be, for example, a supporting cylinder of an apparatus for producing a printing plate. A rubber blanket sleeve can be arranged on the cylinder 1. The present invention can also be used in other cylinders to which a pressure medium under positive pressure or negative pressure is to be connected.

The cylinder 1 has a feed opening 5 on its periphery from which a line (not illustrated) leads to blowing holes (not shown) at the other end of the periphery of the cylinder 1. The blowing holes pass through the peripheral face of the cylinder 1. The printing plate sleeve 2 or a rubber blanket sleeve can be expanded elastically by means of the compressed air emerging from the blowing holes and can then be pushed onto or off of the cylinder 1 in the axial direction.

A feed part 6 having a connection 7 and an outlet 8 for the pressure medium is positioned on the cylinder 1. The connection 7 and the outlet 8 are arranged at the ends of a piston rod 9 of a working cylinder 10, which is fixed to the frame 4. The piston rod 9 is provided with a continuous longitudinal bore 11, so that the pressure medium can be led through the piston rod 9 from the connection 7 to the outlet 8. The outlet 8 is arranged so that it points towards the feed opening 5 of the cylinder 1, (i.e., in the plane which contains the feed opening 5) and is at right angles to the axis of rotation of the support cylinder 1.

The feed opening 5 and the outlet 8 are designed as a pair of tapers, the internal taper 12 being arranged on the bore 11 in the feed opening 5 and the external taper 13 being arranged on the outlet 8. Conversely, the external taper 13 can be arranged on the feed opening 5 and the internal taper 12 can be arranged on the outlet 8. One of the tapers, the external taper 13 in the embodiment show in FIG. 1, bears a sealing ring 14.

By means of appropriate activation with a fluid, advantageously compressed air, the piston rod 9 is moved out of the position show in FIG. 1, such that the external taper 13 having the outlet 8 enters the internal taper 12 of the feed opening 5. The pressure medium applied to the connection 7 can then be activated and introduced into the cylinder 1 via the longitudinal bore 11, the outlet 8 and the feed opening 5. In the process, the circular or sealing ring 14 seals off the parts to be connected. In addition, the external and the internal taper 13, 12 engage each other in a largely form fitting manner and therefore block the cylinder 1 reliably against rotation. At the same time, it is possible to maintain the blocking when the pressure medium is switched off. During this blocking, even when the drive motor of the cylinder 1 is switched on, maintenance work, for example, washing the printing plate or covering it with rubber, can be performed. The mutual engagement of outlet 8 and feed opening 5 can also be achieved using other contours, for example, with a cylindrical feed opening and a cylindrical outlet pin, the transitions being chamfered. Due to the radial arrangement of the feed device 6, a short design of the cylinder 1 is possible.

In the aforementioned plane of the feed opening 5, it is also possible to arrange at least one further fitting 15 on the circumference of the cylinder 1 which resembles the feed opening 5 with respect to the contour, i.e., at least one further bore having an internal taper 12. When the feed part 6 is moved into the fitting 15, the cylinder 1 is locked in a predetermined position corresponding to the arrangement of the fitting 15. This can be done without activating a pressure medium at the connection 7, simply by activating the working cylinder 10 appropriately.

Figure 2:
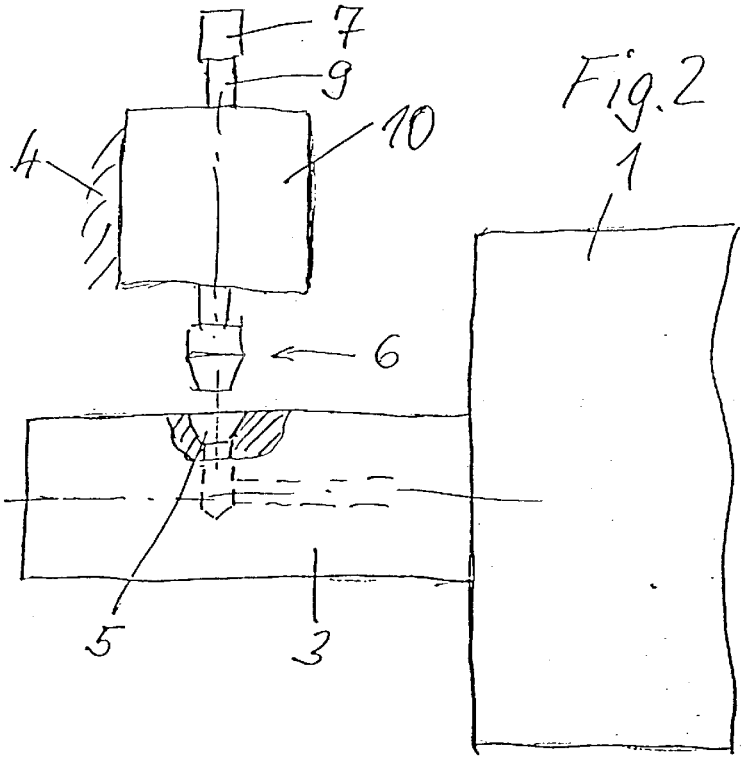
FIG. 2 shows a further embodiment of the present invention.

A further embodiment of the present invention is shown in FIG. 2. In this embodiment, the feed opening 5 is arranged on a circumferential face of a journal 3 belonging to the cylinder 1. By means of an actuating element, for example, a working cylinder 10, the feed part can be placed on the feed opening 5.

Figure 3:
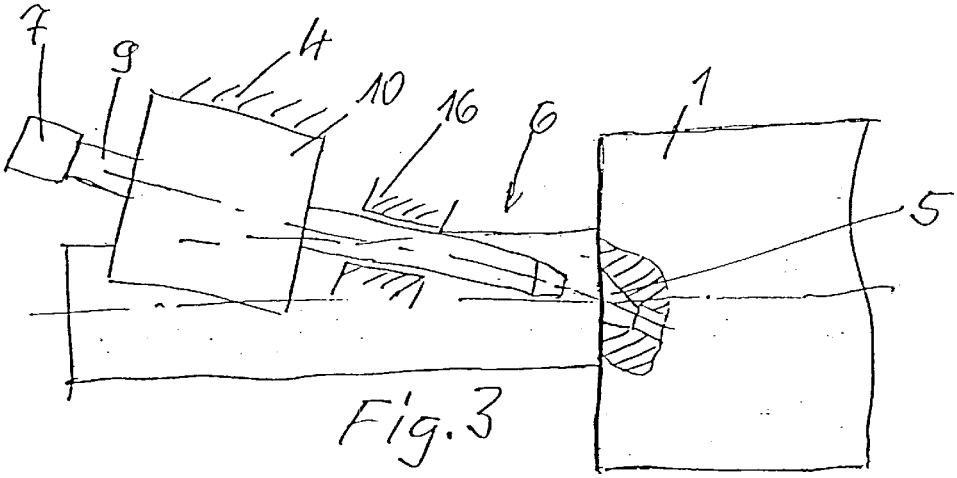
FIG. 3 shows a still further embodiment of the present invention.

Referring now to FIG. 3, another embodiment is shown with the feed opening 5 being arranged on an end of the body of the cylinder 1. In this case, the connecting part 6 is designed to be longer so as to match the local spatial conditions. It is fixed to the piston rod 9 of the working cylinder 10, and, for example, mounted in a bearing 16 fixed to the frame 4. The installation freedom needed to accommodate the working cylinder 10 is obtained by means of a certain oblique position of the working cylinder 10 in relation to the axis of the cylinder 1. The installation conditions may be improved further by bending the feed part 10. With the limited oblique position of the feed part 6, it is possible to lock the cylinder 1 securely.

Figure 4:
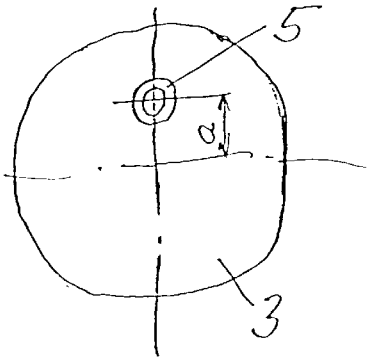
FIG. 4 shows a still further embodiment of the present invention.

Referring now to FIG. 4, the end of a journal 3 belonging to a cylinder 1 is shown. The feed opening 5 is arranged a sufficiently large distance "a" away from the axis of rotation of the cylinder 1 so as to provide the action of locking the cylinder against the rotation.

Figure 5:
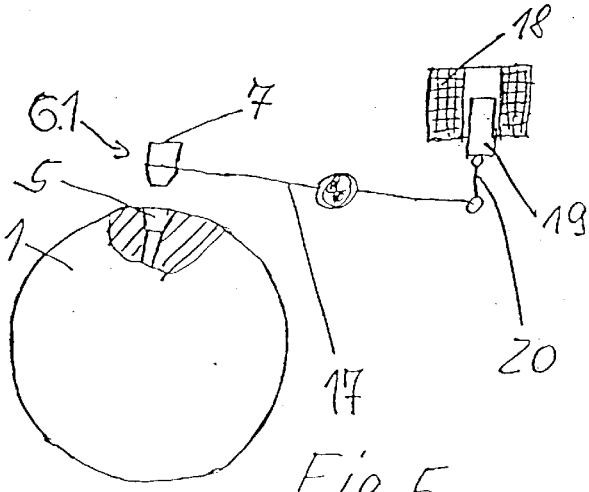
FIG. 5 shows a still further embodiment of the present invention.

A further embodiment of the present invention is shown in FIG. 5, wherein the feed part 6.1 is fixed to a lever 17. When the liver 17 is pivoted, the outlet 8 of the feed part 6.1 can be pivoted onto the feed opening 5. The controllable actuating element provided for the lever 17 is, for example, an electromagnet 18, whose armature 19 is connected to the lever 17 by means of a coupler 20.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A device for feeding a pressure medium to a rotatable cylinder for accommodating one of a printing plate sleeve and a rubber blanket sleeve, the device comprising:

a rotatable cylinder having a feed opening for a pressure medium;

a feed part having an outlet and a connection, the feed part being connectable to a pressure medium source; and an actuating element operatively attached to the outlet and the connection, the actuating element being fixedly mounted to the device and being capable of clamping the outlet part to the feed opening and being independent of a supply of the pressure medium to the device, wherein the feed opening and the outlet are releasably engaged when the feed part is clamped to the feed opening so as to lock the cylinder against rotation.

2. The device according to claim 1, wherein the feed opening and the outlet are tapered.

3. The device according to claim 2, wherein the feed opening is designed as a bore having an internal taper, and the outlet has an external taper.

4. The device according to claim 3, further comprising a sealing ring arranged between the internal taper and the external taper.

5. The device according to claim 1, wherein the feed opening is arranged on a periphery of the cylinder.

6. The device according to claim 1, wherein the cylinder has a body, the feed opening being arranged on an end of the body of the cylinder.

7. The device according to claim 1, wherein the actuating element is a working cylinder including a piston rod having a continuous longitudinal bore having a first end and a second end, wherein the connection is at the first end of the bore and the outlet is at the second end of the bore.

8. The device according to claim 1, further comprising:

a pivotable lever attached to the feed part, wherein when the lever is pivoted, the outlet is pivoted onto the feed opening, the actuating element being hinge mounted on the lever.

9. The device according to claim 1, wherein the actuating element is an electromagnet.

10. The device according to claim 8, wherein the actuating element is an electromagnet.

11. The device according to claim 1, further comprising:

at least one fitting arranged on the cylinder and having a contour that is complementary to a contour of the outlet, wherein the cylinder can be locked by placing the outlet onto the fitting.

12. A device according to claim 1, further comprising:

a journal having a circumferential face and being part of the cylinder, wherein the feed opening is in the circumferential face of the journal.

13. The device according to claim 12, wherein the journal includes an end, the feed opening being arranged on the end of the journal and being offset with respect to an axis of rotation of the cylinder.

* * * * *